US009538298B2

(12) United States Patent
Wu

(10) Patent No.: US 9,538,298 B2
(45) Date of Patent: Jan. 3, 2017

(54) ATTENUATING TIP FOR HEARING AID

(71) Applicant: Zounds Hearing, Inc., Tempe, AZ (US)

(72) Inventor: Fan Wu, Scottsdale, AZ (US)

(73) Assignee: Zounds Hearing, Inc., Tempe, AZ (US)

( * ) Notice: Subject to any disclaimer, the term of this patent is extended or adjusted under 35 U.S.C. 154(b) by 30 days.

(21) Appl. No.: 14/521,085

(22) Filed: Oct. 22, 2014

(65) Prior Publication Data

US 2015/0036857 A1 Feb. 5, 2015

Related U.S. Application Data

(63) Continuation of application No. 12/001,247, filed on Dec. 11, 2007, now Pat. No. 8,873,785.

(51) Int. Cl.
*H04R 25/00* (2006.01)

(52) U.S. Cl.
CPC ..... *H04R 25/652* (2013.01); *H04R 25/604* (2013.01); *H04R 25/656* (2013.01); *H04R 25/658* (2013.01); *H04R 2225/021* (2013.01); *H04R 2225/025* (2013.01); *H04R 2460/11* (2013.01)

(58) Field of Classification Search
CPC ..... H04R 25/604
USPC ..... 381/324, 380
See application file for complete search history.

(56) References Cited

U.S. PATENT DOCUMENTS

| | | | | |
|---|---|---|---|---|
| 3,080,011 | A | 3/1963 | Henderson | |
| 4,459,247 | A | 7/1984 | Rothemund | |
| 4,727,582 | A | 2/1988 | De Vries et al. | |
| 4,830,139 | A | 5/1989 | Cirillo | |
| 4,880,076 | A | 11/1989 | Ahlberg et al. | |
| 5,665,922 | A | 9/1997 | Tsukada et al. | |
| 6,585,075 | B1 | 7/2003 | Gauthier | |
| 6,724,902 | B1 * | 4/2004 | Shennib | H04R 25/456 381/322 |
| 7,016,512 | B1 * | 3/2006 | Feeley | 381/322 |
| 7,720,242 | B2 | 5/2010 | Anderson et al. | |
| 2002/0080979 | A1 | 6/2002 | Brimhall et al. | |
| 2003/0002700 | A1 * | 1/2003 | Fretz | H04R 25/65 381/330 |
| 2004/0215053 | A1 | 10/2004 | Jorgensen et al. | |
| 2005/0147269 | A1 | 7/2005 | Oliveira et al. | |

(Continued)

FOREIGN PATENT DOCUMENTS

EP 0466961 Al 1/1992

OTHER PUBLICATIONS

"Reducing Feedback in a Post-Auricular Hearing Aid by Implanting the Receiver in an Earmold", by Mark Ross and Raymond Cirmo, The Volta Review, Jan. 1980, pp. 40-44.

*Primary Examiner* — Duc Nguyen
*Assistant Examiner* — Phan Le
(74) *Attorney, Agent, or Firm* — Cahill Glazer PLC

(57) ABSTRACT

A hearing aid includes a speaker in a tip that is located in an ear canal. The tip includes a coupling, a retainer that mechanically engages the coupling, and a sleeve axially surrounding the retainer. The retainer attenuates lower frequencies than are attenuated by the sleeve. The sleeve is preferably a foam rubber and the retainer is preferably a composite material. A flange on the retainer reflects sound back into the sleeve for additional attenuation. It has been discovered that operation is improved if the outside diameter of the sleeve and the outside diameter of the retainer are in the ratio of approximately 1.75:1.

7 Claims, 3 Drawing Sheets

(56) References Cited

U.S. PATENT DOCUMENTS

2008/0240485 A1* 10/2008 Dyer ..... H04R 1/1016
381/380

* cited by examiner

ATTENUATING TIP FOR HEARING AID

CROSS-REFERENCE TO RELATED APPLICATION

The present patent application is a continuation of earlier-filed, non-provisional, co-pending parent patent application Ser. No. 12/001,247, filed Dec. 11, 2007, and the benefit of the Dec. 11, 2007 filing date of such earlier-filed patent application Ser. No. 12/001,247 is hereby claimed.

This invention relates to hearing aids and, in particular, to a tip for insertion in the ear canal, wherein the tip significantly attenuates sound that would otherwise be transmitted through the canal.

BACKGROUND TO THE INVENTION

A "speaker" generates sound from an electrical signal. In the hearing aid art, one often encounters the term "receiver" for such a device, which reads strangely to the uninitiated. "Electroacoustic transducer" is clumsy and pedantic. Thus, "speaker" is the term used for describing this invention.

A human ear canal is a narrow, irregular, tubular structure, approximately 25 mm in length. Coupling amplified sound to the eardrum at the inner end of the canal is not as simple as it might seem. In a hearing aid, a microphone is connected to a speaker by a high gain (60-80 dB) amplifier and is relatively close to the speaker. An earpiece containing a speaker is assumed to fit the ear canal and the tissue of the ear canal is relied upon to isolate the speaker from the microphone.

If the earpiece should move slightly and not seal the ear canal, an acoustic path is opened, coupling the speaker to the microphone, which permits sound from the speaker to be fed back to the microphone. Feedback typically occurs at high frequencies due to the higher gain at these frequencies, where most hearing loss occurs. The misalignment of the earpiece manifests itself as an unpleasant squeal that can be audible even to those several feet from the hearing aid. The squeal can be eliminated by reducing the gain of the amplifier by way of a volume control on the hearing aid. Often the wearer is obliged to adjust the gain frequently as the loudness of background sounds and the loudness of sounds of interest change. Feedback in a hearing aid can interfere with hearing and may cause the wearer not to use the hearing aid. High level feedback in a hearing aid may even damage the already impaired hearing of the wearer.

Hearing aids can be divided into four groups: Behind-The-Ear (BTE), In-The-Ear (ITE), In-The-canal (ITC), and Completely-In-the-Canal (CIC). Some BTE hearing aids have an advantage over other types because the speaker is relatively far from any microphone in the body of the hearing aid. Before speakers became small enough to fit in an ear canal, it was known to add sound absorbing material to the earpiece of a BTE hearing aid; for example see U.S. Pat. No. 3,080,011. It has long been known that putting the speaker in the ear canal reduces feedback in a BTE hearing aid. See "Reducing Feedback in a Post-Auricular Hearing Aid by Implanting the Receiver in an Earmold", Ross and Cirmo, The Volta Review, January 1980, pages 40-44. (Post auricular means behind the ear). See also U.S. Pat. No. 4,727,582 (de Vries et al.). Distance and dispersion provide some attenuation but, for those severely impaired, these are not enough. The high gain used for at least some frequencies assures that sufficient sound reaches a microphone for oscillation or squeal.

A tip having a foam sleeve or jacket is known in the art and can be used with any type hearing aid but is primarily used with BTE hearing aids. The tip contains a speaker. The sleeve provides a resilient coupling to the wall of the ear canal and provides some attenuation of the sound traveling in either direction along the canal.

It is known in the art to form the sleeve in the canal and it is known to pre-form the sleeve. In some cases, the sleeve is designed for comfort; e.g. U.S. Pat. No. 4,880,076 (Ahlberg et al.). It is alleged for other sleeves that feedback is prevented; e.g. U.S. Pat. No. 4,830,139 (Cirillo) and U.S. Pat. No. 6,724,902 (Shennib et al.). It is known in the art to make a sleeve from foam; e.g. U.S. Pat. No. 4,459,247 (Rothemund). Despite these disclosures, there remains a need in the art for a jacketed tip that is comfortable to wear and that prevents feedback even at high gain. That is, there is a need for a jacketed tip that attenuates sound a minimum of 40 dB and preferably 60 dB, particularly at and above 1,000 Hz.

In view of the foregoing, it is therefore an object of the invention to provide a jacketed tip for a hearing aid that provides at least 40-60 dB of attenuation and is comfortable to wear.

Another object of the invention is to provide a jacketed tip for a hearing aid that provides at least 40 dB of attenuation even at low frequencies A further object of the invention is to provide a pre-formed, high attenuation sleeve for a hearing aid.

Another object of the invention is to provide a high gain, BTE hearing aid with a speaker in the ear canal surrounded by sound absorbing, resilient material.

SUMMARY OF THE INVENTION

The foregoing objects are achieved by this invention in which a hearing aid includes a speaker in a tip that is located in an ear canal. The tip includes a coupling, a retainer that mechanically engages the coupling, and a sleeve axially surrounding the retainer. The retainer attenuates lower frequencies than are attenuated by the sleeve. The sleeve is preferably foam and the retainer is preferably a composite material. A flange on the retainer reflects sound back into the sleeve for additional attenuation. It has been discovered that operation is improved if the outside diameter of the sleeve and the outside diameter of the retainer are in the ratio of approximately 1.75:1.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
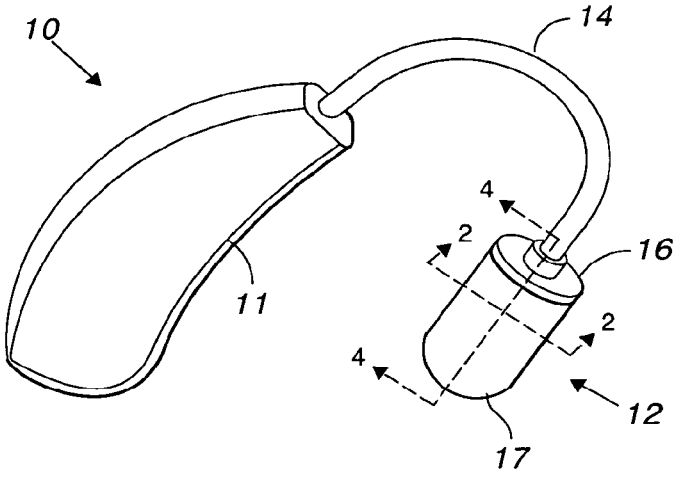
FIG. 1 is a perspective view of a behind-the-ear hearing aid.

FIG. 1 is a perspective view of a behind-the-ear hearing aid having an earpiece containing a speaker and surrounded by a sound absorbing sleeve constructed in accordance with the invention. The drawing is not necessarily to scale.

Hearing aid 10 includes a sculptured body 11 that contains one or more microphones, a battery, and audio processing circuitry that provides correction for impaired hearing. Earpiece 12 preferably contains at least one speaker coupled to the audio processing circuitry in body 11 by cable 14. The speaker (not shown) is suitably supported on coupling 16 which is surrounded by tip 17. Tip 17 resiliently supports earpiece 12 in an ear canal, acoustically seals the canal, and absorbs sound generated by the speaker.

A tip constructed with the invention can be located anywhere in the ear canal. That is, the tip need not be "completely-in-canal" (touching the bony portion of the ear canal) but is inserted a sufficient distance for the tip to engage the canal about the circumference of the tip.

Figure 2:
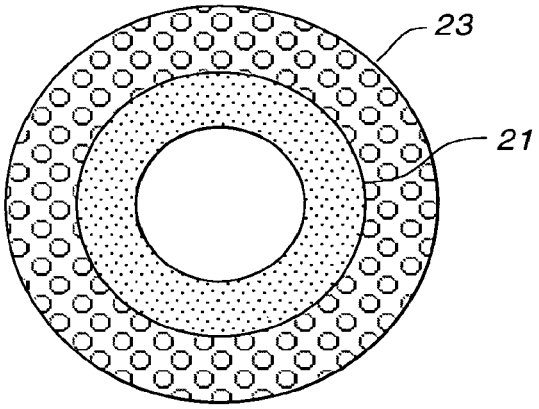
FIG. 2 is a cross-section taken along line 2-2 in FIG. 1.

FIG. 2 is a cross-section of earpiece 12 taken along line 2-2 in FIG. 1. In accordance with one aspect of the invention, tip 17 includes two parts, each designed to absorb sound in different parts of the audio spectrum. Retainer 21 is a composite, specifically a filled rubber, that absorbs low frequencies; e.g. frequencies below 1,000 Hz. Sleeve 23 axially surrounds retainer 21 and is made from a foam rubber that has high density and slow recovery time and absorbs high frequencies (above 1,000 Hz) better than retainer 21. Retainer 21 has an interior shape complementary to the shape of coupling 16 (FIG. 1) to which it is attached, preferably by interference fit. A frequency of 1,000 Hz is not a hard boundary but is used for the sake of description. The ranges of frequencies necessarily overlap because the retainer and the sleeve are not sharp cut-off filters. In accordance with another aspect of the invention, it has been found that retainer 21 is preferably a composite material, specifically an organic carrier containing inorganic filler. Fine (e.g. 10-3-10-4 mm) particles of barium sulphate ($BaSO_4$) is preferred as the filler. In general, the more dense the filler, the better the acoustical performance. For example, barium sulphate is more dense than "Mistron® vapor" (fine particles of talc—magnesium silicate) and performs better than talc. As used herein, "density" refers to the density of the material relative to water, not the amount of filler per unit volume of rubber. A mixture of 5 weight percent of filler in rubber has been found suitable. The retainer is less resilient than the sleeve. The preferred organic carrier is butyl rubber. The sleeve is preferably made by reacting MDI (methylene diphenyl diisocyanate) with polyol, producing a dense foam. This material is known in the art as a thermal insulator. Preferably the foam has a specific gravity of 0.1 or higher.

Figure 3:
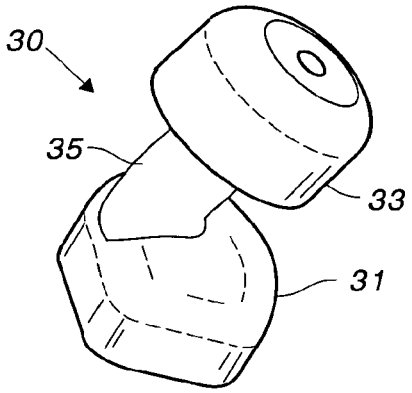
FIG. 3 is a perspective view of an in-the-canal hearing aid including an attenuating tip constructed in accordance with the invention.

FIG. 3 is a perspective view of in-the-canal hearing aid 30 including an attenuating tip constructed in accordance with the invention. Hearing aid 30 includes body 31 housing the necessary electronics, battery, and microphone (not shown). The earpiece includes foam sleeve 33 axially surrounding a retainer (not shown in FIG. 3), which is joined internally to coupling 35. The construction and performance of the foam sleeve and the retainer is the same as the embodiment of FIG. 1.

In accordance with another aspect of the invention, it has been found that the geometry of the tip affects performance. Specifically, sleeve 23 preferably has a thickness of at least 0.25 mm. The outside diameter of the tip can vary from 6.5 mm to 13.5 mm, depending upon the particular patient, but is typically about 10.5 mm. It has been found that the outside diameter of sleeve 23, represented by the letter a in FIG. 4, and the outside diameter of retainer 21, represented by the letter b in FIG. 4, should be in the ratio (a:b) of approximately 1.75.05:1.

Figure 4:
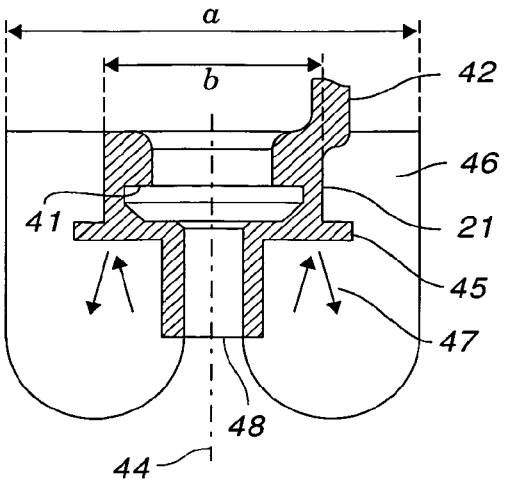
FIG. 4 is a cross-section taken along line 4-4 in FIG. 1.

As illustrated in FIG. 4, retainer 21 has an interior shape that provides an interference fit with coupling 16 (FIG. 1), which contains a speaker (not shown). Specifically, retainer 21 defines interior shoulder 41 for engaging the coupling. The shoulder resists removal of the coupling. Sleeve 23 and retainer 21 are joined by adhesive (not shown). Thus, the components are securely joined for normal use. In the event a coupling is accidentally pulled out, a pull tab or stem 42 is optionally provided for removing the earpiece from the ear canal.

Dash-dot line 44 represents the center line and longitudinal axis of the tip. In accordance with another aspect of the invention, flange 45 is located near the longitudinal middle of retainer 21 and extends radially into sleeve 45 further than other portions of the retainer. Flange 44 has been found to facilitate attenuation by reflecting sound, particularly high frequencies, from within the canal back through a portion of foam sleeve 45, as indicated by arrows 47. Flange 45 provides a large surface area, relative to diameter b of retainer 21, for reflecting sound. That is, distal end 48 has an outside diameter less than b. The longitudinal location of the flange can be changed to adjust the acoustic characteristics of the earpiece.

Figure 5:
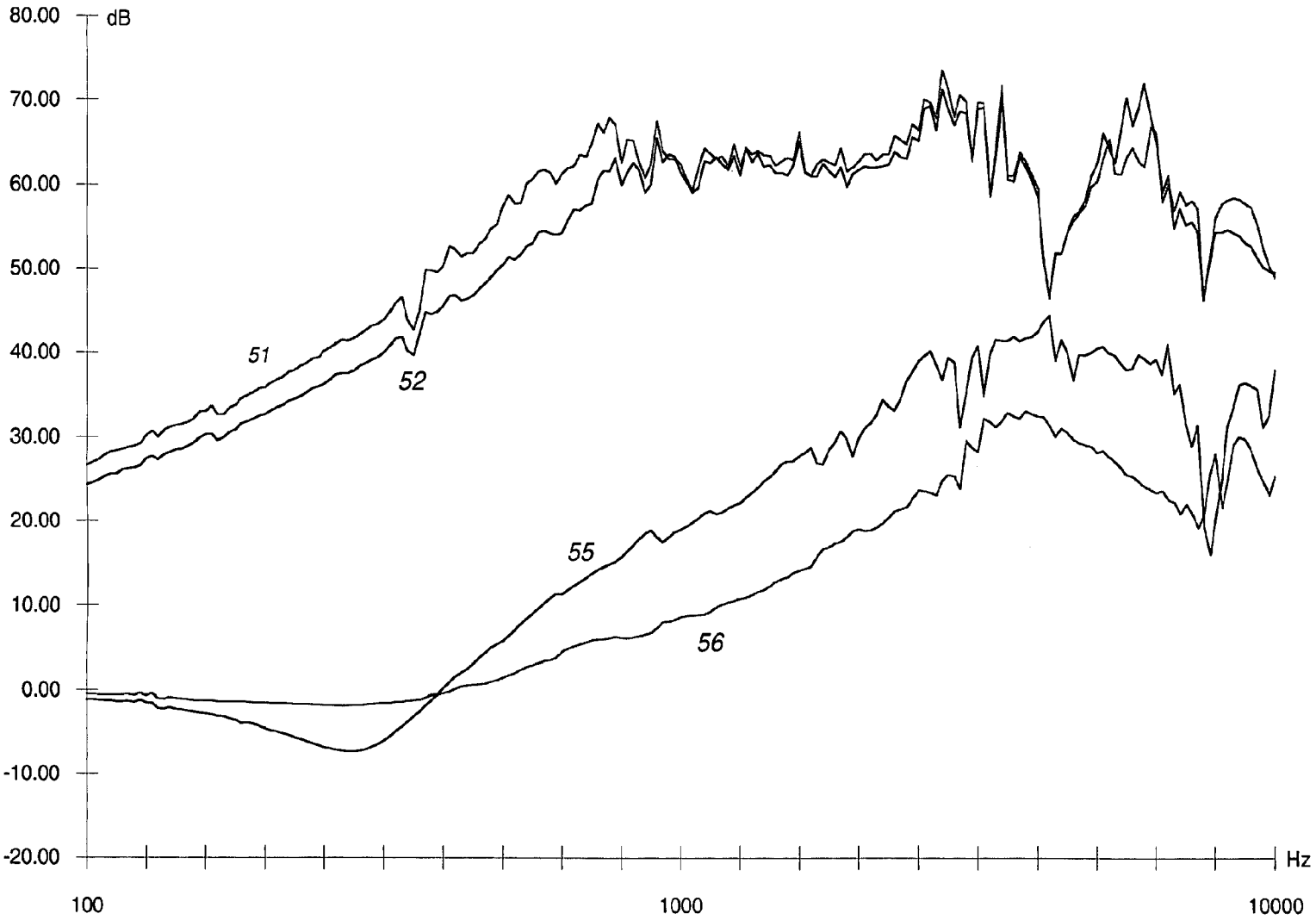
FIG. 5 is a chart comparing an earpiece constructed in accordance with a preferred embodiment of the invention with a commercially available earpiece.

FIG. 5 is a chart comparing an earpiece constructed in accordance with a preferred embodiment of the invention with an earpiece having a solid silicone tip from Phonak AG. The tip is considered a quality component in the art. The sound level of the input signals was +74 dB SPL. The amplitudes of attenuated sounds were subtracted from the amplitudes of non-attenuated sounds and the differences plotted for FIG. 5. The chart is a plot of attenuation (dB) vs. frequency (Hz). In FIG. 5, curve 51 represents the attenuation of an earpiece constructed in accordance with a preferred embodiment of the invention and deeply inserted into an ear canal. Curve 52 represents the attenuation of the earpiece loosely inserted into an ear canal. The pronounced dip at approximately 4 kHz. is believed to be an artifact of the test equipment. Curve 55 represents the attenuation of an earpiece having a Phonak tip and deeply inserted into an ear canal. Curve 52 represents the attenuation of the earpiece having a Phonak tip loosely inserted into an ear canal. The pronounced dip at approximately 8 kHz. is believed to be an artifact of the test equipment.

Figure 6:
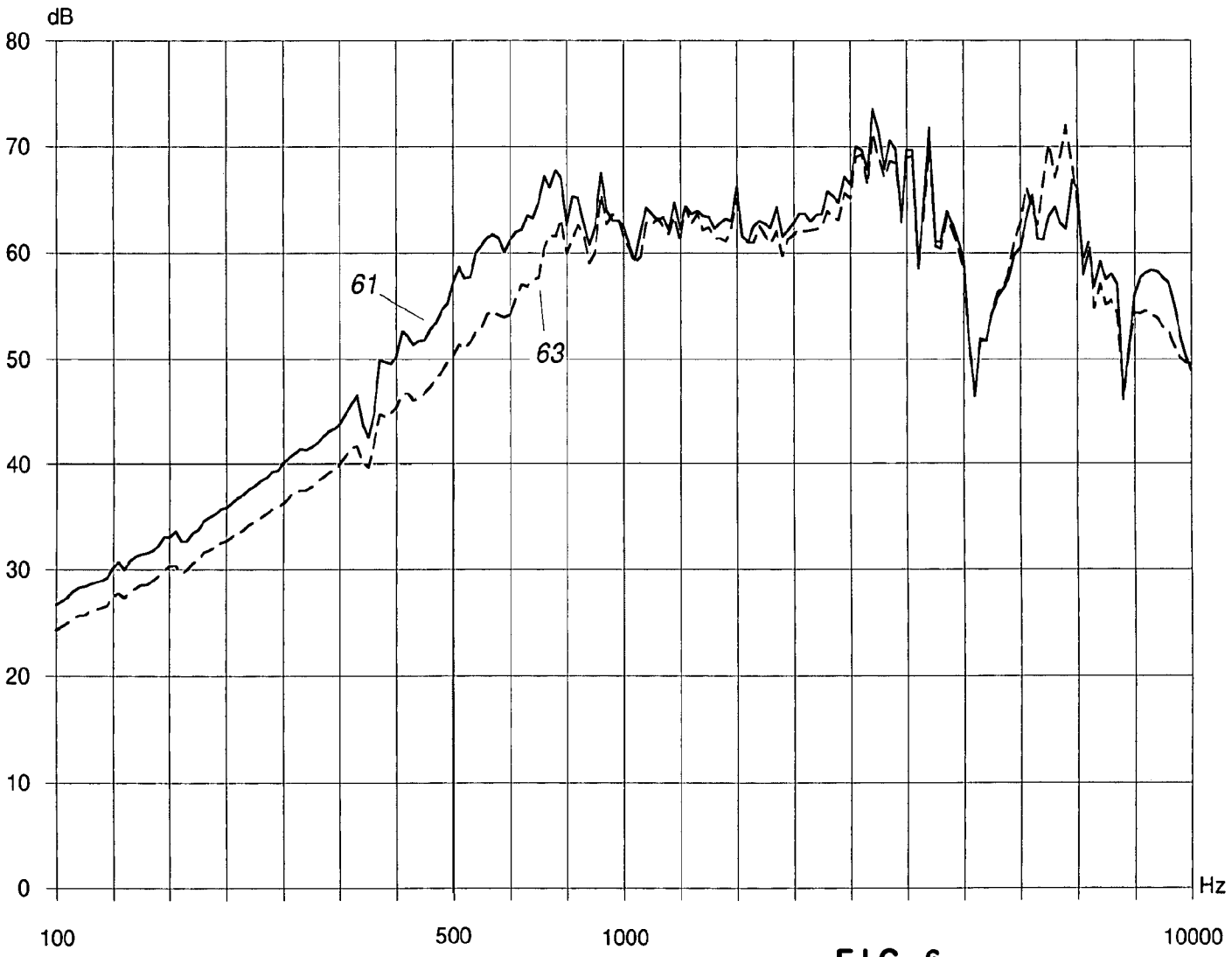
FIG. 6 is a chart of the attenuation of an earpiece constructed in accordance with an alternative embodiment the invention.

FIG. 6 is a chart of the attenuation of an earpiece constructed in accordance with an alternative embodiment the invention. For FIG. 6, the sleeve had a heat shrinkable covering. Curve 61 represents the attenuation of a tip deeply inserted into an ear canal. Curve 63 represents the attenuation of a tip near the outer end of an ear canal but fully engaging the canal. For a substantial portion of the audio spectrum, attenuation was greater than 60 dB. Although insertion depth has some effect on attenuation, the tip is relatively immune to variation in insertion depth.

The invention thus provides a jacketed tip for a hearing aid that provides at, least 40-60 dB of attenuation and is comfortable to wear. The tip provides at least 40 dB of attenuation at low frequencies and 60 dB of attenuation at high frequencies. The retainer and sleeve are pre-formed and is suitable for use in a BTE hearing aid capable of high gain (greater than 60 dB).

Having thus described the invention, it will be apparent to those of skill in the art that various modifications can be made within the scope of the invention. For example, retainer 21 can be held in place by interference fit, frictional engagement, a fractional turn locking mechanism, or other technique.

I claim:

1. A hearing aid including an earpiece, wherein the earpiece is located in an ear canal during use, characterized in that the earpiece includes:

a coupling containing a speaker;

a retainer that mechanically engages the coupling, the retainer being formed separately from the coupling, and the retainer being formed of a composite material including an organic carrier and an inorganic filler, the retainer having a first end for mechanically engaging the coupling and a second end opposite the first end thereof, the first end having a first outside diameter, and the second end having a second outside diameter, the first outside diameter being larger than the second outside diameter; and a sleeve axially surrounding the retainer, the sleeve being formed of foam rubber;

wherein said retainer and said sleeve attenuate different ranges of audio frequency, and wherein said retainer attenuates lower frequencies than are attenuated by the sleeve.

2. The hearing aid as set forth in claim 1 wherein:

a) said inorganic filler being substantially uniformly distributed within said organic carrier; and b) said composite material extending substantially entirely through said retainer.

3. The hearing aid as set forth in claim 1 wherein said sleeve has an outside diameter, a, and said retainer has an outside diameter, b, and the ratio a:b is approximately 1.75:1.

4. The hearing aid as set forth in claim 1 wherein the organic carrier, included within the composite material, comprises rubber.

5. The hearing aid as set forth in claim 1 wherein said hearing aid is an in-the-ear hearing aid.

6. The hearing aid as set forth in claim 1 wherein said hearing aid is a behind the ear hearing aid.

7. The hearing aid as set forth in claim 1 wherein said hearing aid has a gain greater than 60 Db.

* * * * *